US005761994A

United States Patent [19]

Itakura

[11] Patent Number: 5,761,994

[45] Date of Patent: Jun. 9, 1998

[54] MULTI-SLIDE MECHANICAL PRESS WITH PHASE DIFFERENCE

[75] Inventor: Hideo Itakura, Sagamihara, Japan

[73] Assignee: Aida Engineering Ltd., Kanagawa-ken, Japan

[21] Appl. No.: 667,383

[22] Filed: Jun. 21, 1996

[51] Int. Cl.[6] ..... B30B 7/00

[52] U.S. Cl. ..... 100/209; 72/404; 100/237; 100/282

[58] Field of Search ..... 100/137, 193, 100/207, 208, 209, 282, 285; 72/404

[56] References Cited

U.S. PATENT DOCUMENTS

| | | | |
|---|---|---|---|
| 3,030,878 | 4/1962 | Holzer | 100/237 |
| 4,137,840 | 2/1979 | Kubota | 100/209 |
| 5,069,057 | 12/1991 | Lee | 100/282 |

FOREIGN PATENT DOCUMENTS

| | | | |
|---|---|---|---|
| 178270 | 4/1954 | Austria | 100/209 |
| 0439684 | 8/1991 | European Pat. Off. | 100/282 |
| 2625881 | 12/1976 | Germany | 100/209 |
| 5-8092 | 1/1993 | Japan | 100/282 |
| 1446041 | 8/1976 | United Kingdom | 100/237 |

*Primary Examiner*—Stephen F. Gerrity
*Attorney, Agent, or Firm*—Wood, Phillips, VanSanten, Clark & Mortimer

[57] ABSTRACT

A multi-slide mechanical press comprising a plurality of slides, wherein each of the slides is provided with a guide that reciprocatingly drives the associated slide, without having to increase the pitch between slides, and that makes it possible to eliminate the effects of the presence of a gap around a slide adjust screw section. In the multi-slide mechanical press, the upper section of each slide is prismatic, while the lower section is cylindrical. Pressure-bearing guides disposed at the frame are provided so as to oppose the front and back sides of the prismatic section. A cylindrical guide provided in the frame for the cylindrical section of each slide guide guides the slide vertically but without allowing it to rotate.

3 Claims, 6 Drawing Sheets

MULTI-SLIDE MECHANICAL PRESS WITH PHASE DIFFERENCE

BACKGROUND OF THE INVENTION

1. Field of the Invention

The present invention relates to a multi-slide mechanical press.

2. Description of the Related Art

In conventional multi-slide mechanical presses, having a plurality of slides, that operates to form a component part by pressing in a plurality of steps, the slides do not have the same phases, and cannot be changed later. Thus, these conventional presses could only be used for pressing to form particular component parts.

When an attempt is made to form a new, unplanned component part by pressing using such conventional mechanical presses, while a certain pressing step is being performed, either a different pressing step for forming the new component part may be started by a different slide, or a different pressing step may still be carried out for forming the new component part. In such a situation, the pressing load that is experienced by the mechanical press is equal to the sum of the individual pressing loads that are simultaneously produced by the slides. In such a case, the mechanical press experiences a larger pressing load compared to the case where simultaneous pressing by the slides is not performed. Thus, the mechanical press, which experiences a greater pressing load, is deformed by a greater amount. When a new component part is formed by such a mechanical press by pressing, there is more vibration and more noise and the operations of the slides are affected thereby, which results in a problem of reduced operational precision of the slide for a pressing step requiring high precision. In addition, since there is an increase in the pressing load, each part of the mechanical press, including the driving mechanism from the drive source, and thus the mechanical press must be made larger to provide extra capacity.

The type of guide, which guides a slide in a reciprocating fashion, most often used in the mechanical press is a square-shaped guide that guides the slide at the four corners of the slide. A cylindrical guide is also used for guiding some slides. When a square-shaped guide is used, however, it is necessary to dispose the guide between adjacent slides that are separated by a small space, making it difficult to give enough strength to the guides that are provided for each of the slides. This has caused problems such as a smaller allowable pressing load of each slide and insufficient pressing precision. On the other hand, the cylindrical guide requires an anti-rotation mechanism that prevents rotation of the slides.

The slide adjustment mechanism, provided for adjusting the die height of each slide of the mechanical press, is a screw mechanism that has a gap between thread sections of a female screw and an adjust screw. A slight rotation of the adjust screw in the gap during pressing, or the presence of the gap itself causes variations in the lower dead center position of the slide.

SUMMARY OF THE INVENTION

Accordingly, a first object of the present invention is to provide a multi-slide mechanical press, having a plurality of slides, that operates to form a component part by pressing in a plurality of steps, in which the allowable load value for each slide is the same as the conventional allowable pressing load value for each slide, the sum of the individual slide pressing loads experienced by the mechanical press is low so that there is less deformation in the mechanical press, and each slide can move with high precision.

In the mechanical press of the present invention, a crank shaft is provided for every shaft in order to drive the respective shaft. The phases of the crank shafts are set by phase adjusting devices in order to drive the slides so that their pressing operations do not overlap each other. When this is done, the order of the pressing operations and the phase differences are changed and fixed, as required.

When a component part is formed as a result of pressing in the forging process, the component part is most often molded in three steps. They are: (1) the preliminary molding step; (2) the molding step; and (3) the finishing molding step. The amount of pressing load experienced by each slide is medium in the preliminary molding step, large in the molding step, and small in the finishing molding step.

A mechanical press with three slides is used in the aforementioned three molding steps. In a large part of the forging process, the slides are within 30 degrees before the lower dead center, when pressing is performed to form a component part. Thus, the phase difference between each crank shaft that drives its respective slide is successively changed and fixed to about 30 degrees. In the preliminary molding step, pressing is performed by A slide. In the molding step, pressing is performed by the B slide, and in the finishing molding step, pressing is performed by the C slide. Within the remaining amount of time after the pressing has been completed, the component part is transferred by a transfer device or the like and pressed. Obviously, the phases of the crank shafts may be adjusted by the phase adjustor so that the pressing is performed first by the C slide, then by the B slide, and then by the A slide.

When pressing is performed to obtain a component part in the forging process and the maximum phase difference between each slide is set at 60 degrees, the pressing performed by the slides do not overlap, so that the amount of pressing load that is experienced by the mechanical press is only equal to the pressing load required for a single slide, thus resulting in less deformation and less vibration in the mechanical press, with the pressing precision of each slide maintained at a high level.

A second object of the present invention is to provide a mechanical press having a plurality of slides, in which the slides can be kept moving reciprocatingly with high precision and have enough strength, without increasing the pitch between adjacent slides, and in which the guide provided for each slide is an anti-rotation guide, and in which the affects of the presence of a gap around a die height adjust screw of each slide is eliminated, during pressing.

Each slide in the present invention has an upper section, which is prismatic, formed integrally with a lower section, which is cylindrical. The frame of the mechanical press is provided with pressure-bearing guides at locations facing the front and back faces of the prismatic section of the slide. The guides guide the slides vertically so as to move them in a reciprocating fashion, and hold them so that they cannot rotate. Cylindrical guides are provided along the outer periphery of the cylindrical section of each slide in order to guide the slides vertically.

The component force experienced by each slide in the forward and backward directions, and the force that tries to cause rotation are exerted on the pressure-bearing guides at the front and back sides of the prismatic section, and the pressure-bearing guides and the cylindrical guides guide the slides in the vertical direction. Therefore, it is possible to maintain the precision of the reciprocating motion and rotational positioning of the slide.

Each slide is provided with a female thread at the lower part of the cylindrical section, and an adjust screw, the top portion of which is externally threaded, that is brought into engagement therewith. A pressure-bearing plate, in contact with the lower face of the adjust screw, is provided within a cylinder that is fixed to the lower face of the cylindrical section of the slide. The construction of the lower face of the pressure-bearing plate is such as to allow the cope of a die to be mounted thereto. When pressing, pressure oil is supplied to a hydraulic chamber defined by the cylinder and the pressure-bearing plate. The pressure-bearing plate and the adjust screw in contact therewith is pushed up, and a flank of the female thread and a flank of the male thread in engagement with the female thread are moved relative to each other so as to contact each other. This prevents rotation of the slide and the adjust screw relative to each other, making it possible to maintain the lower dead center of each slide during pressing and ensure the precision of the component parts to be formed by pressing.

DESCRIPTION OF PREFERRED EMBODIMENTS

Figure 1:
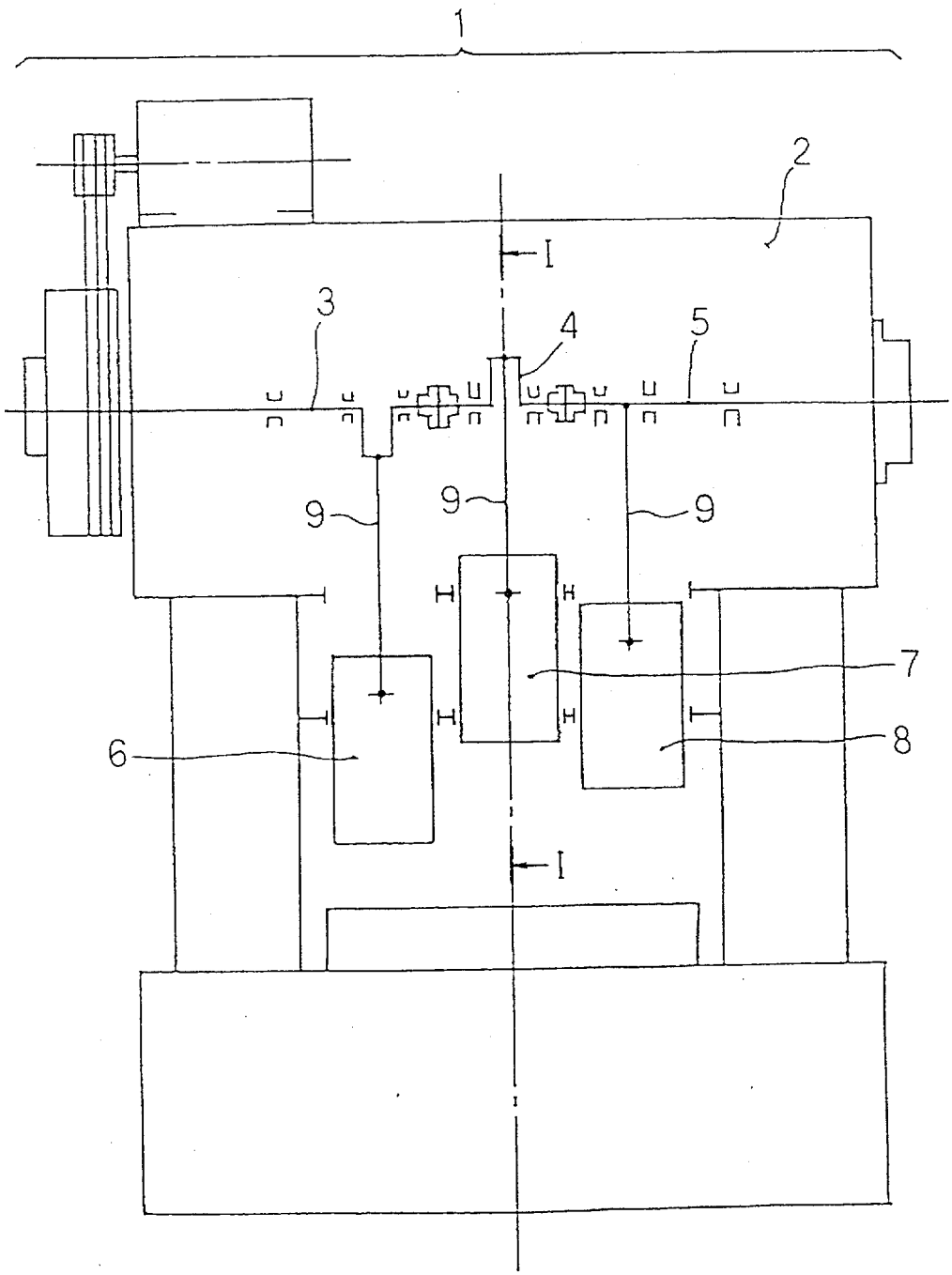
FIG. 1 is a front view of a mechanical press of the present invention.

One aspect of the present invention will be described with reference to FIGS. 1 to 4 which show an embodiment of the present invention.

Referring to the figures, A crank shaft 3 reciprocatingly drives A slide 6 via a connecting rod 9. B crank shaft 4 reciprocatingly drives B slide 7 via another connecting rod 9. C crank shaft 5 reciprocatingly drives C slide 8 via another connecting rod 9. Phase adjustors 10, 10 are disposed between the A crank shaft 3 and B crank shaft 4, and between the B crank shaft 4 and the C crank shaft 5, respectively, in order to adjust the phase angle of a crank shaft.

Figure 2:
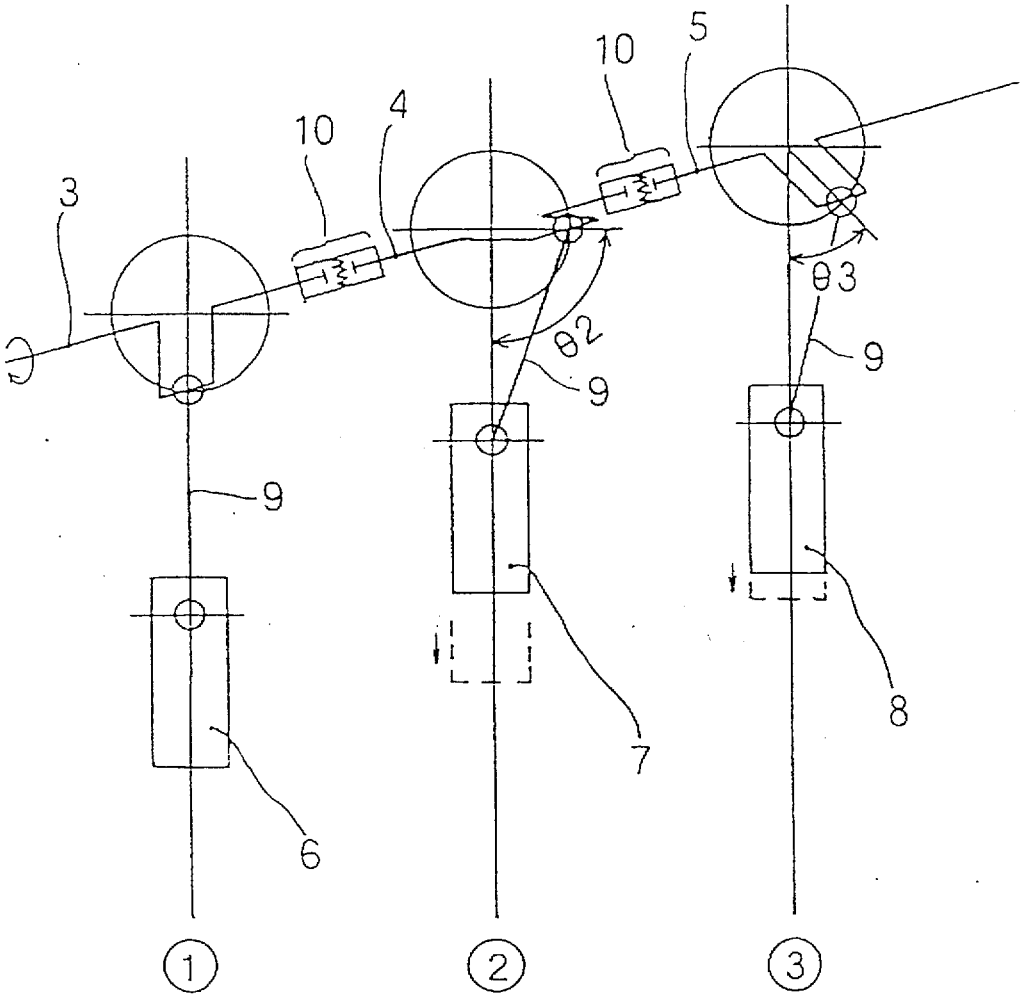
FIG. 2 is illustrative of the phases of the slides of the present invention.

FIG. 2 illustrates the case where the B slide 7 is θ2 degrees before the lower dead center, and the C slide 8 is θ3 degrees before the lower dead center, while the A slide 6 is kept at the lower dead center. The θ2 and θ3 degree angles can be changed and fixed by the phase adjustor 10.

Figure 3:
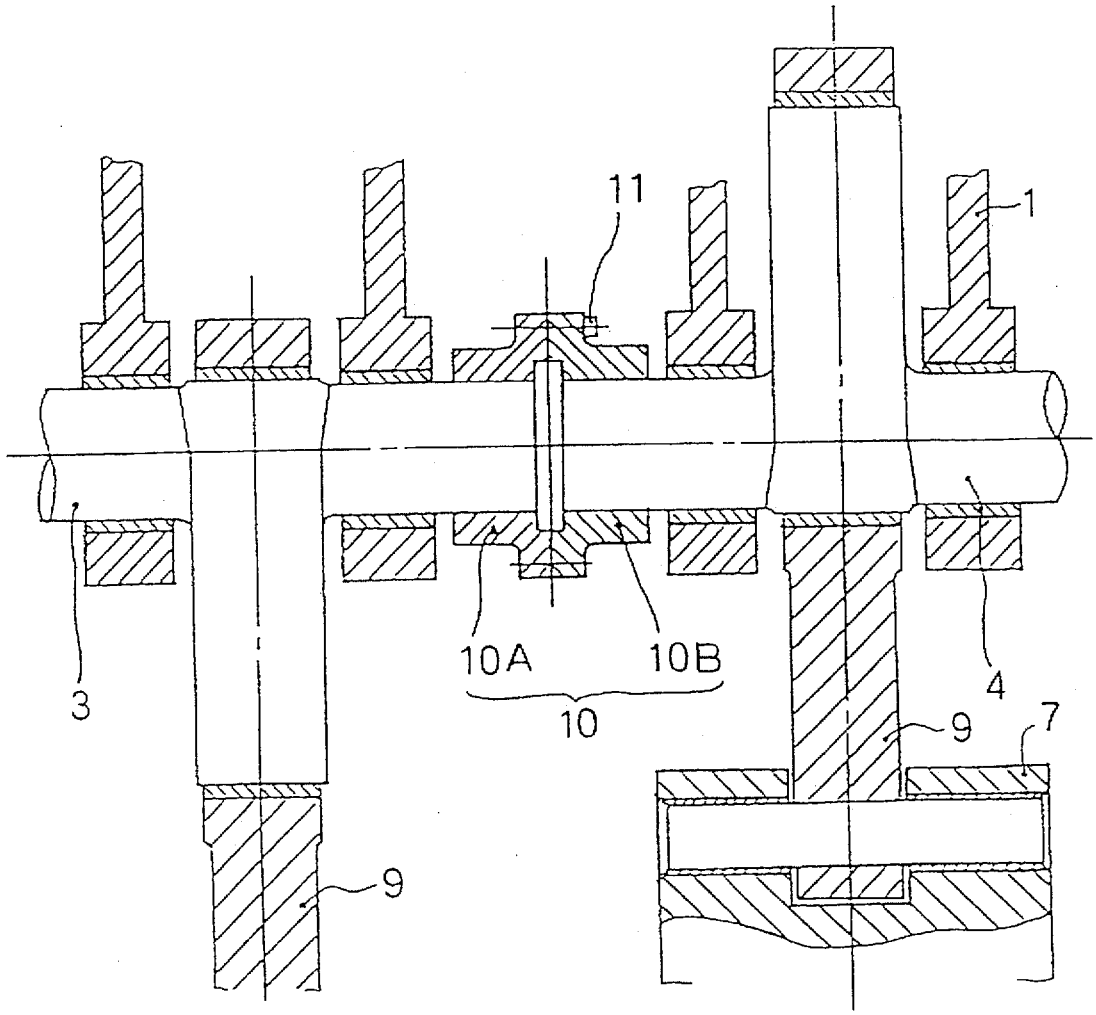
FIG. 3 is a detailed view of the phase adjusting device portion of the mechanical press of the present invention.

The phase adjustor 10 is so constructed as having an A coupling 10A affixed to the A crank shaft 3, and a B coupling 10B affixed to the B crank shaft 4. The gear-like structures of the A coupling 10A and the B coupling 10B engage each other at their junction, with the couplings secured together by a bolt 11. In order to change and fix the phase, the bolt 11 is loosened to disengage the couplings. Then, the A crank shaft 3 or the B crank shaft 4 is rotated so that A slide 6 or B slide 7 is set at a required phase angle, after which the A coupling 10A and the B coupling 10B are brought into engagement and fastened together by tightening the bolt 11. Though the A crank shaft 3 and the B crank shaft 4 illustrated in FIG. 3 are both of the full eccentric type, they may be of the usual crank type. Since another phase adjustor 10 is also provided between the B crank shaft 4 and the C crank shaft 5, the phase angle of the B slide 7 or the C slide 8 can be changed and fixed to a new phase angle in the same way.

Figure 4:
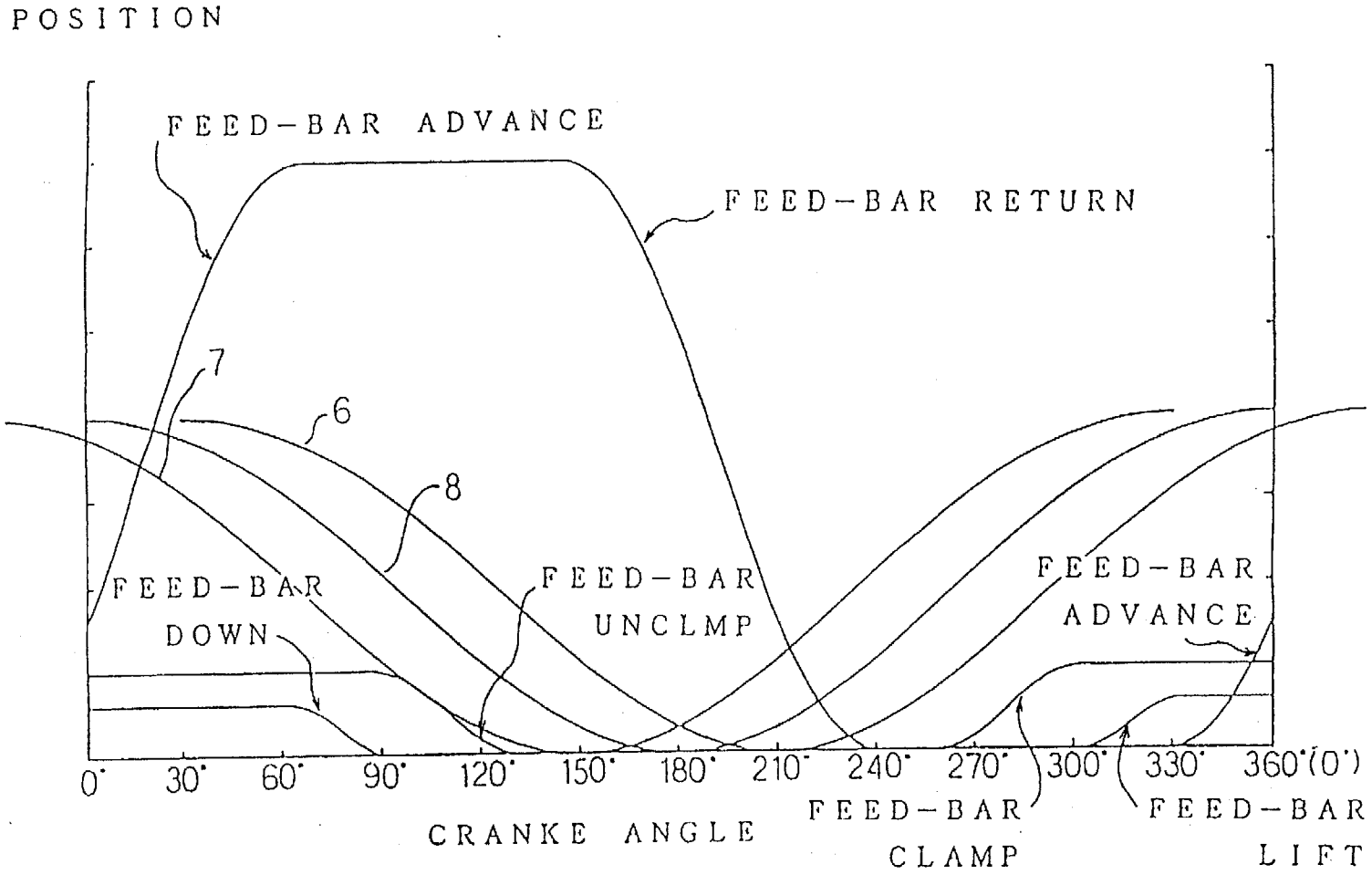
FIG. 4 is a graph showing the timing of each slide and a parts transferring device of the mechanical press of the present invention.

FIG. 4, being a timing graph, indicates the operations of a transferring device (not shown) that uses a feed bar, and the positions of the slides 6, 7, and 8 with the passage of time. In the graph the angle of the C crank shaft 6 is used as reference. From the information of the graph, and previously obtained changes in the pressing load is experienced by the slide in each step performed for producing a component part, it is possible to determine the sum of the individual slide pressing loads that is experienced by the mechanical press, and the degree to which these pressing loads are exerted simultaneously. It can be seen from the graph that the crank shafts 3 and 5 and 4 and 5 are 30 degrees out of phase, in which θ2 equals 60 degrees and θ3 equals 30 degrees. The operations of the feed bar, advance·return, clamp·unclamp, and lift·down, are also written on the graph. It can be seen from the timing graph that a pressing component part can be transferred by a transfer device.

Figure 5:
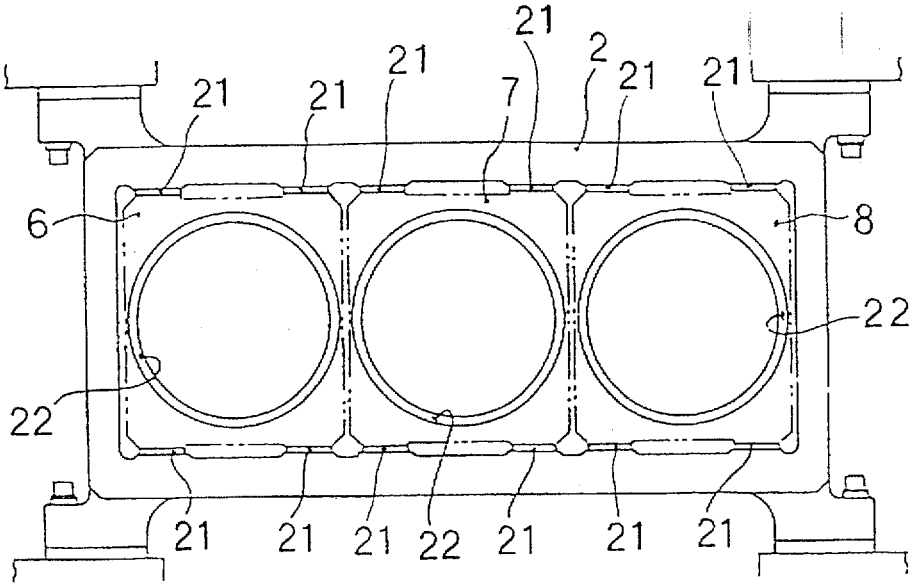
FIG. 5 is a plan view illustrating the critical portion of the frame, including a slide guide section, of the mechanical press of the present invention.
Figure 6:
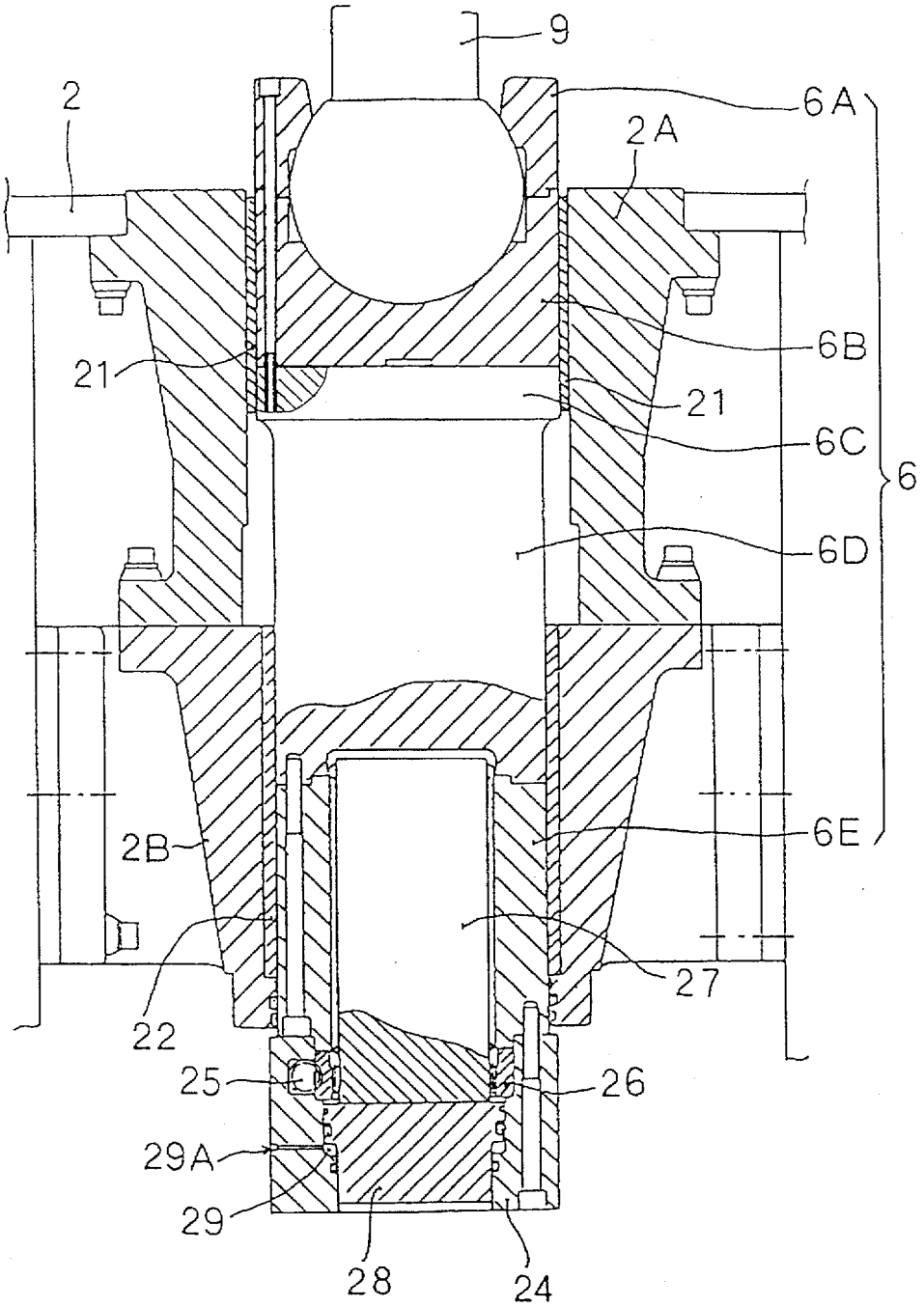
FIG. 6 is a cross sectional view of a slide adjusting section of the mechanical press of the present invention.

Another aspect of the present invention will be described with reference to FIGS. 1 and 5 and 6, which show an embodiment of the present invention.

The upper prismatic section of the slide 6 of the mechanical press 1 is formed by members 6*a* and 6B, and an upper section 6C. The members 6A and 6B rotatably link the spheroid of the bottom portion of the connecting rod 9 to the slide 6. The lower cylindrical section of the slide 6 is formed by a lower portion 6D and a female screw member 6E.

A plurality of pressure-bearing guides 21 are fixed along an upper guide member 2*a* of the frame 2 in order to guide the upper prismatic section of the slider 6. A cylindrical guide 22 is fixed to a lower guide member 2B of the frame 2 in order to guide the lower cylindrical section. When motive force is transmitted to the slide 6 from the crank shaft 3, and the rotational angle of the connecting rod 9 is θ, a horizontal force component that acts in the back-and-forth direction occurs at the slide 6, in addition to a driving force that drives the slide 6 in the vertical direction. The plurality of pressure-bearing guides 21 are subjected to the horizontal motive component force, and prevents rotation of the slider 6.

The plurality of pressure-bearing guides 21 and the cylindrical guide 22 guide the slider 6 in a reciprocating fashion, thus making it possible to preserve the accuracy of the reciprocating motion.

The guide mechanisms of the sliders 7 and 8 operate in essentially the same fashion as the guide mechanisms of the slider 6.

The plurality of pressure-bearing guides 21, which guide the prismatic section of the slider 6, are provided at the front and back sides of the prismatic section of the slider 6, but not at the left and right sides of the prismatic section, so that it is not necessary to widen the pitch between adjacent slides. Thus, it is possible to reduce the left and right side dimensions of the mechanical press 1.

An externally threaded portion of an adjust screw 27 engages the internally threaded portion of the female screw member 6. A worm wheel 26 that is movable in the vertical dimension but is not capable of rotating is disposed below the adjust screw 27. A worm shaft 25 is accommodated in a cylinder 24 in order to drive the worm wheel 26. A pressure-bearing plate 28 is also accommodated in the cylinder 24, with the top face of the pressure-bearing plate 28 being in contact with the adjust screw 27. The cylinder 24 and the pressure-bearing plate 28 form a hydraulic chamber 29. Below the pressure-bearing plate 28 is mounted a die used for pressing. The lower portion 6D and the female screw member 6E of the slider 6 may be formed into an integral structure, though in the present embodiment the lower portion 6D and the female screw member 6E are separately formed. Rotational driving of the worm shaft 25 causes rotation of the worm wheel 26, which in turn rotates the adjust screw 27. The amount of vertical movement of the pressure-bearing plate 28 with respect to the slide 6 is determined, followed by supplying of pressure fluid from a lubricator port 29A to a hydraulic chamber 29, whereby slide adjustment is completed. Except when a slide is to be adjusted, the mechanical press is left in this state. The pressure-bearing plate 28 in the cylinder 24 is pushed upward, causing the adjust screw 27 to be pushed upward, as a result of which a flank of the female screw member 6E and a flank of the adjust screw 27 in the screw section are moved relative to each other so as to contact each other in order to prevent rotation of the adjust screw 27. This causes the gap between the flank of the female thread and the flank of the male thread is eliminated, so that the adjust screw 27 does not rotate. This maintains the lower dead center position of the die mounted to the slider at a constant position.

Means for rotatably driving the worm shaft 25 (not shown) can be operated manually or with a motor.

The adjusting mechanisms of the slides 7 and 8 essentially operate in the same manner as the adjusting mechanism of the slide 6.

What is claimed is:

1. A multi-slide mechanical press comprising a plurality of slides that are driven by a drive source, wherein:

each of said plurality of slides is provided with a crank shaft that drives the associated slide, each of the adjacent crank shafts for driving the associated slide having provided therebetween a phase adjusting device, each of said phase adjusting devices changing and fixing the phase angle of the respective crank shafts so that said plurality of slides are allowed to operate with the required phase differences, wherein the press comprises three slides, being a left slide, a right slide and a center slide, the phase angle of each of said crank shafts for driving the respective slides being shifted by 30 degrees from each other so that the order in which said slides start operating is the left slide, the right slide, and the center slide.

2. The multi-slide mechanical press according to claim 1 wherein the slides are driven vertically through respective crank shafts via respective connecting rods, wherein the upper section of each of said slides being prismatic is integrally formed with the lower section of each of said slides being cylindrical, pressure-bearing guides being disposed in a frame so as to oppose the front and the back sides of the prismatic section, a cylindrical guide being disposed in said frame and along the outer periphery of the cylindrical section of each of said slides, whereby each of said slides is guided vertically.

3. A multi-slide mechanical press according to claim 2, further comprising a slide adjusting mechanism, wherein said adjusting mechanism includes a female screw provided at the lower portion of said cylindrical section of each of said slides, a female thread portion of said female screw being brought into engagement with a male thread portion provided at the upper portion of an adjust screw, the lower face of said adjust screw being in contact with a pressure-bearing plate disposed within a cylinder fixed to the lower end of said cylindrical section of said slide, the lower face of said pressure-bearing plate having mounted thereto a cope of a die, said cylinder and said pressure-bearing plate defining a hydraulic chamber for supplying pressure oil thereto in order to push said pressure-bearing plate and said adjust screw upward and move a flank of said female thread and a flank of said male thread in engagement with said female thread relative to each other so as to contact each other as a result of which the gap between the flanks is eliminated, whereby the screws are prevented from rotating relative to each other.

* * * * *